US006036996A

United States Patent [19]

Martin

[11] Patent Number: 6,036,996

[45] Date of Patent: Mar. 14, 2000

[54] METHOD OF IMPACT PLATING A BULLET WITH A POWDERED LUBRICANT

[75] Inventor: Merrill D. Martin, Oakland, Calif.

[73] Assignee: Martin Family Trust, Oakland, Calif.

[21] Appl. No.: 09/249,368

[22] Filed: Feb. 12, 1999

Related U.S. Application Data

[63] Continuation-in-part of application No. 09/064,689, Apr. 22, 1998, abandoned.

[51] Int. Cl.[7] ..... B05D 5/08

[52] U.S. Cl. ..... 427/190; 427/11; 427/242

[58] Field of Search ..... 427/11, 242, 190, 427/475

[56] References Cited

U.S. PATENT DOCUMENTS 3,497,376 2/1970 Wieser .

4,454,175 6/1984 Martin .

4,753,094 6/1988 Spears .

*Primary Examiner*—Fred J. Parker

*Attorney, Agent, or Firm*—James R. Cypher; Charles R. Cypher

[57] ABSTRACT

Metal jacketed or lead alloy bullets are placed in a tumbler or vibratory device and mixed with a selected quantity of steel shot having either the same size or a plurality of different sizes and tungsten disulfide powder. The mixture is tumbled or vibrated for a selected time until the tungsten disulfide is plated to the outside surface of the bullets by the impact of the steel shot upon the bullets. This plating acts as a heat resisting and friction reducing lubricant which preserves the interior of the rifle barrel, reduces copper fouling, permits shooting at normal barrel pressures and faster bullet velocities and improves the accuracy of the shooting.

22 Claims, No Drawings

METHOD OF IMPACT PLATING A BULLET WITH A POWDERED LUBRICANT

This is a continuation-in-part of application Ser. No. 09/064,689 filed Apr. 22, 1998 abandoned.

This application relates to a method of impact plating a surface such as the surface of metal jacketed or lead alloy bullet with a powdered lubricant.

BACKGROUND OF THE INVENTION

The desirability of applying a lubricant to bullets to be fired from a rifle has been long recognized. In my patent entitled Method of Applying Lubricant Coating to Bullets U.S. Pat. No. 4,454,175 Martin, granted Jun. 12, 1984, this art was raised to a new level by firing bullets plated with molybdenum disulfide using the method set forth in my patent.

In the lower working velocity ranges, such as military competition and bench rest, hundreds of molybdenum disulfide plated bullets could be fired, without copper fouling the rifle barrels. Raising the velocity to the mid-3000 to high 3,000 feet per second range, however and the molybdenum disulfide plated bullets could not hold back the copper fouling of the rifle bore. These higher velocities are desired for long range shooting in the wind, and varmint shooting with light bullets at high velocities.

SUMMARY OF THE INVENTION

I have discovered a new method of impact plating a powdered lubricant, viz., tungsten disulfide ($WS_2$) on copper or steel jacketed bullets so that they can be fired at higher velocities in the mid to upper 3000 feet per second range. I have further discovered that by plating ($WS_2$ ) on top of bullets plated with molybdenum disulfide ($MoS_2$), I experienced no copper fouling with velocities over 4000 feet per second.

Moreover, I have found that providing dual size steel shot balls has increased the effectiveness of the plating process for both molybdenum disulfide plating and tungsten disulfide plating and reduced the time for achieving the desired amount of plating.

Surprisingly, using the tungsten disulfide plating process I have also achieved better shooting accuracy than previously with the same rifle.

Accordingly, having solved the high velocity fouling of rifle barrels, a whole new field of reloading has been opened up. Light bullets can be used instead of slower, heavier bullets with their concomitant recoil problem.

Since accuracy normally deteriorates rapidly as the velocity is increased and shots are fired more rapidly, the reversal of this well established rule will bring back a new excitement in high velocity shooting.

Moreover, as I increased the recommended powder charges much higher than was possible without the tungsten disulfide processed bullets, I did not have the serious over-pressure problems such as blown primers, stuck cases or difficulty in opening the rifle. None of this was experienced as I exceeded the listed velocities measured with my own chronograph.

Normally, trying to go into these velocity ranges is a disaster in accuracy and damage to the cartridges. No signs of over-pressure were found anywhere—just good shooting.

DESCRIPTION OF MY PROCESS

I start with an impact device such as a typical commercial tumbler such as that used to tumble and clean brass cartridge casings. One such tumbler is known commercially as the "Viking" and gives satisfactory results, although I have found that impact devices that vibrate the materials work even faster and give superior results such as the Lyman Vibratory tumbler.

Into such tumblers I place a charge of spherical steel shot varying from ⅛" to 3/16" for 22 caliber bullets and no larger than about ¼" for larger caliber bullets; selecting a tumbler that holds about 4 pounds of shot and 100, 30 caliber bullets or the equivalent of any weight from 125 grains to 200 grains. Into this I pour approximately one-half ounce of tungsten disulfide powder having a fineness of 4–25 microns. I then rotate the tumbler or vibrate the vessel and have discovered that the impact of the steel shot mixed with the tungsten disulfide powder causes a thin film of tungsten disulfide to form on the relatively soft outside surface of the bullets by what may be characterized as a form of mechanical or impact plating I operate the tumbler from one to two hours depending upon how thick a film of lubricant is desired. I have found that when tumbling bare bullets for about one to two hours, the diameter of the bullet increased about 0.0003 inches. I have been able to increase the diameter of the bullet by 0.0007 inches . In other words, the film attains a thickness of 0.00015 inches to 0.00035 inches.

When plating tungsten disulfide on top of molybdenum disulfide plated bullets, the diameter of the bullet is increased by about 0.0007 to 0.0008 inches.

The process described above comprises a form of mechanical or impact plating. The plating so formed adheres very strongly to the bullet surface, is very difficult to remove, and presents a polished surface which is not affected by being pushed tightly or seated in its cartridge case neck. In short, the tungsten disulfide does not rub off very readily or at all and requires no further processing to be effective. I have found that the interior of the rifle barrel remains smooth, as well as clean, often after more than 40 shots have been fired and often requires no cleaning after many more shots.

The improved lubricating qualities I obtain for both the bare bullets plated with tungsten disulfide as well as the double plated bullets having a first molybdenum plating and a second tungsten disulfide plating increase the accuracy for firing and the interior surface of the rifle appear to be free from copper galling.

I have found that using hardened steel balls available from a lapidary. rather than soft steel balls does a better job of peening the bullet surface.

I have inspected recovered bullets and even mushroomed bare bullets as well as bullets plated with molybdenum disulfide using my new process; most of which still have up to 90% of the tungsten plating.

I have also conducted another test which indicates that the tungsten disulfide plating remains on the bullets. I fired several rounds of tungsten disulfide bullets at paper targets and found that the area around the openings remained very clean. On the other hand, a series of bullets fired at a paper target with molybdenum plated bullets using the plating method set forth in my patent U.S. Pat. No. 4,454,175 left dark areas around the bullet openings. Unexpectedly, as to bullets having a plating of molybdenum disulfide covered by a plating of tungsten disulfide, the area around the bullets holes in the paper targets were even cleaner than holes made by bullets plated with a single plating of tungsten disulfide.

A major benefit of using bullets plated with tungsten disulfide is keeping the rifle barrel clean. When an unplated bullet is fired, the temperatures in the barrel are so high that as the bullet travels down the rifle barrel, the copper from a copper jacketed bullet wipes off and is deposited on the rifle barrel. On the other hand, when the bullet is plated with tungsten disulfide using the method of the present invention, the tungsten disulfide prevents the copper from rubbing off the copper jacketed bullet.

In the tests set forth above, I used tungsten disulfide having a fineness of 4–25 microns and bearing a ratio of approximately one-half once of powder to four pounds of steel shot. I have also used tungsten disulfide by Osram Sylvania which passes a sub-sieve size 0.8–1.2, a molecular weight of 248.02, and absolute density of 7.4 g/cm$^3$, has a crystal structure which is laminar, layer-lattice type with alternate layers of tungsten (W) and sulfur (S); a color which is Grayish-black and a Moh's Scale hardness of 1.0–1.5.

I have found that the methods set forth above in which bare bullets are plated may be equaled and even succeeded by applying a plating of tungsten disulfide over bullets plated with molybdenum disulfide using the method set forth in my patent U.S. Pat. No. 4,454,175 granted Jun. 12, 1984. In the U.S. Pat. No. 4,454,175 patent, I disclosed a method of applying a lubricating plating of molybdenum disulfide ($MoS_2$) to the outer surface of bullets comprising the steps of placing a selected number of bullets in a tumbler containing a barrel; adding a predetermined amount of spherical steel shot to the barrel; mixing the above ingredients with a predetermined amount of molybdenum disulfide ($MoS_2$) powder within the barrel; adding a predetermined amount of a granulated fibrous material for polishing the lubricating plating of the above ingredients completing the mixture in the barrel; and impacting the shot within the mixture upon the bullets by tumbling the barrel containing the bullets and the mixture until a fine film of molybdenum disulfide having a polished surface is made to adhere to the outer surface of the bullets.

In still another method, molybdenum disulfide is plated by impacting the bullets with steel shot without a fibrous material.

While I have been able to obtain excellent results using the method set forth above, I find that I can slightly improve the shooting accuracy still further and clean up the bullets by applying the following additional steps.

In most instances it will benefit the plating method by tumbling or vibrating the bullets in a tumbling wash in a selected quantity of fibrous material such as commercially available corn cob grits of medium granulation for a period of two to five minutes. The amount of corn cob grits and the tumbling time is dependent upon the initial condition of the bullets.

While the methods described above perform perfectly satisfactorily, I have discovered that by using steel shot of two different sizes improves the plating of molybdenum disulfide ($MoS_2$) to bullets, the plating of tungsten disulfide ($WS_2$), to bullets, and the plating of tungsten disulfide over bullets previously plated with molybdenum disulfide. The largest steel ball that can practically be used at the present time should be smaller than the bullet so that the steel ball can be screened out and separated from the plated bullets with a simple sieve. As an example, a 3/16" ball is smaller than a 0.22 caliber bullet and can be easily separated using a screen. A 1/4" steel ball works fine for 0.30 caliber bullets and gives the necessary harder blow needed.

As an example of steel ball sizes, I have found the larger balls may be found in commercial grade sizes of 1/4" to 3/16". The smaller balls preferably have one half the size of the larger steel balls. The standard sizes of shot now commercially available are 1/4", 3/16", 1/8", and 1/16". The smaller ball need not be one half the size of the larger ball. For example a 3/16" ball could be used with a 1/8" ball. The steel balls should be hardened steel of about 60 Rockwell and polished.

The problem with the single size large balls for each caliber bullet was the accumulation of the powdered lubricant, $MoS_2$ or $WS_2$ on the large ball which softens their impact against the bullet. The addition of two different size balls serves two purposes. First, a high percentage of the large steel balls strike the smaller steel balls which in turn strike the powdered lubricant which is impacted against the surface of the bullet much like a peening hammer. The smaller surface of the smaller steel ball being struck by a larger and heavier ball exerts a much higher surface pressure in forcing the powdered lubricant against the surface of the bullet. Secondly, the smaller steel balls tend to act as a cleaning device in knocking accumulated powdered lubricant off the surface of the larger balls so that there can be a higher percentage of metal to metal contacts between the larger and smaller balls. Thus the overall force exerted by the larger heavier ball hitting the smaller steel ball against the lubricant powder and forcing it against the bullet surface is much higher. Thirdly, the use of smaller steel balls with larger steel balls tends to prevent build-up of powdered lubricant on the sides of the tumbler receptacle.

I have found that various ratios of large steel balls to small steel balls may be used, but as an example, using small steel balls, approximately equal in total weight to the total weight of the large balls gives satisfactory results I have also found that using a volume ratio, the ratio of larger balls to smaller balls works well even at a ratio of 2 to 1.

I have also experimented with the relative size of the small steel balls to the large steel balls and several ratios work, but as an example I have found that when the small balls are approximately 1/2 the diameter of the large steel balls or 1/4 the weight, I obtain satisfactory results.

Another interesting feature of using two different size steel balls is the fact that somehow, as stated above, the small balls not only tend to wash off the surplus powder from the tumbler sides, but the small balls wash off powder from the outside diameter of the large balls and the bullet surfaces, allowing the full impact of the larger ball in metal to metal contact against the bullet , the full impact of the smaller balls against the bullet and most importantly the full impact of a larger ball striking a smaller ball which in turn impacts the bullet with greater force. It is this last described larger ball against a smaller ball which achieves the greatest force for plating the powdered lubricant onto the surface of the bullet.

As an example, in a 10-lb. capacity vibratory tumbler, 3 lbs of each ball size, plus bullets, plus lubricating powder worked very well.

A secondary beneficial result of using the dual size ball system was the fact that satisfactory plating results were obtained even when too much lubricating powder was added to the mixture, a problem which was always present in the single ball size system due to the build up of lubricating powder on the large single size balls , the bullets and the sides of the vibratory receptacle.

While both vibratory and rotary tumblers can be used for plating and for cleaning, I have found that the vibratory tumblers work best for plating and the rotary tumblers work well for cleaning. The problem with rotary tumblers used for plating is the fact that the bullets tend to ride up the wall of the rotary tumbler with their axis parallel to the axis of rotation of the tumbler, but the bullets tend to ride down the wall with their stream lined points perpendicular to the axis of rotation of the tumbler and perpendicular to the axis of the bullets riding up the walls. During the long impact plating time, the points of the bullets tend to become blunted and even the squared ends of the bullets can become mushroomed. On the other hand, during the short time of 2 to 5 minutes, the plated bullets are in the cleaning rotary tumbler, with the fibrous material, there is less impact of pointed ends of bullets against the sides of the plated bullets and less blunting of the points or mushrooming of the planar ends. The running time of a rotary tumbler to wash off the loose lubricating powder is from 2 to 5 minutes to obtain a very shiny surface in which there is practically no loose powder to soil clothes or fingers. The rotary tumblers can also be used before the plating process to remove dirt and oil from the bullets in the presence of a cleaning material such as a fibrous material such as corn cob grits. Here the rotary tumbler is simply operated until the bullets are clean which is generally one half to one hour.

In comparing the molybdenum disulfide and tungsten disulfide plated bullets in firing tests, I have found that I can increase bullet velocity over "standard" velocity by 2 to 5% by plating the bullets with molybdenum disulfide and increase bullet velocity over "standard" velocity by 5 to 10% by plating with tungsten disulfide.

One would surmise that the greater increase in bullet velocity by plating with tungsten disulfide over molybdenum disulfide was simply achieved because the tungsten disulfide plated bullets are more slippery than molybdenum plated bullets. After all, tungsten disulfide has a coefficient of friction that is one half that of molybdenum disulfide. Such a conclusion does not follow. In fact, a tungsten disulfide plated bullet with a standard amount of powder actually will have a slower velocity than a bullet with a standard amount of powder. Stranger still is the fact that a bullet plated with either molybdenum disulfide or tungsten disulfide using the same amount of powder in the cartridge will have a firing velocity less than a bare non-plated bullet.

This anomalous result occurs because the more slippery plated bullets do not provide the necessary back pressure as the powder burns.

Applicant found that the way to achieve "standard" velocity, or the higher than standard velocity when using plated bullets using the above processes was to increase the amount of powder in the cartridge or to substitute faster burning powder.

The results of using bullets plated with tungsten disulfide and achieving 10% greater bullet velocity are dramatic. For example, using tungsten disulfide plated bullets in cartridges having a greater volume of powder or a powder having a faster burning rate, the fire power of a standard rifle can be raised to the level of a much more expensive magnum rifle. It is expected that many shooters will forego the cost of replacing their standard rifles with a more expensive magnum rifle by merely substituting the tungsten disulfide plated bullets with the higher volume of powder or faster burning powder for standard non-plated ammunition.

Use of greater amounts of powder and faster burning powders would normally result in greater barrel fouling from the copper cartridges and copper plated bullets. It has not been known by others or even large arms manufacturers how to increase bullet velocity by up to 10% greater than standard velocity without increased copper fouling of the rifle barrels.

I have found that by plating the bullets and using the proper amount of powder and type of powder has enabled me to avoid any increase in barrel fouling. This is due to the fact that the plated bullets also cause some coating of the rifle barrel. This coating of the barrel plus the lower coefficient of friction over unplated bullets and uncoated rifle bores enables the rifle bores to remain clean without extra cleaning. An added bonus will be extended barrel life if pressures are maintained at standard pressures.

I have further found that the double plated bullets, i.e. bullets plated with molybdenum disulfide and then plated with a second plating of tungsten disulfide permits even greater amounts of powder and faster burning powder and more rounds to be fired before cleaning of the rifle barrel is required.

My experiments have found that at very high velocities of the plated bullets above the 10% velocity increase above standard velocity even the double layer of plated molybdenum disulfide and tungsten disulfide breaks down and fouls the rifle barrel with a very light copper wash; not the usual heavy fouling. Also at such very high velocities, the barrel throat wear occurs from the gas erosion.

There is a growing demand for higher velocity bullets because of the greater accuracy that can be achieved at greater ranges. Wind deflection, as a factor in reducing accuracy e.g. is decreased.

Throughout this specification, the word "plating" rather than "coating" of the bullets has been used. This is to distinguish from those who now practice the method of spraying bullets with molybdenum disulfide from a spray can or who might spray tungsten disulfide from a spray can when this method of plating bullets by impacting steel bullets against the bullet surface in the presence of powdered tungsten disulfide is made known.

I claim:

1. A method of plating tungsten disulfide ($WS_2$) to the outer surface of bullets comprising the steps:

a. placing a selected number of bullets in an impact device containing a receptacle;

b. adding a selected amount of spherical steel shot to said receptacle;

c. mixing said bullets and steel shot with a selected amount of tungsten disulfide ($WS_2$) powder within said receptacle forming a mixture; and d. impacting said shot within said mixture upon said bullets by means of said impact device for a period of one to two hours until a plated layer of tungsten disulfide attains a thickness of approximately 0.00015 inches to 0.00035 inches and is made to adhere to the outer surface of said bullets.

2. The method of claim 1 comprising:

a. adding a selected quantity of fibrous material in said impact device to said previously plated bullets; and b. polishing said plated bullets by impacting said fibrous material and plated bullets for a selected time.

3. The method of claim 1 in which said bullet has a caliber of 0.22 and said larger of said spherical steel shot has a diameter of 3/16".

4. The method of claim 1 in which said bullet has a caliber of 0.30 and said larger of said spherical steel shot has a diameter of ¼".

5. A method of plating tungsten disulfide ($WS_2$) to the outer surface of bullets comprising the steps:

a. placing a selected number of bullets in an impact device containing a receptacle;

b. adding a selected amount of spherical steel shot to said receptacle in which said selected amount of spherical steel shot varies from approximately ⅛ inches to ¼ inches in diameter;

c. mixing said bullets and steel shot with a selected amount of tungsten disulfide ($WS_2$) powder within said receptacle forming a mixture; and d. impacting said shot within said mixture upon said bullets by means of said impact device for a period of one to two hours until a plated layer of tungsten disulfide is made to adhere to the outer surface of said bullets.

6. A method of plating tungsten disulfide ($WS_2$) to the outer surface of bullets comprising the steps:

a. placing a selected number of bullets in an impact device containing a receptacle;

b. adding a selected amount of spherical steel shot to said receptacle in which said steel shot bears a ratio of four pounds of shot per the equivalent of 100, 30 caliber bullets;

c. mixing said bullets and steel shot with a selected amount of tungsten disulfide ($WS_2$) powder within said receptacle forming a mixture; and d. impacting said shot within said mixture upon said bullets by means of said impact device for a period of one to two hours until a plated layer of tungsten disulfide is made to adhere to the outer surface of said bullets.

7. A method of plating tungsten disulfide ($WS_2$) to the outer surface of bullets comprising the steps:

a. placing a selected number of bullets in an impact device containing a receptacle;

b. adding a selected amount of spherical steel shot to said receptacle;

c. mixing said bullets and steel shot with a selected amount of tungsten disulfide ($WS_2$) powder within said receptacle forming a mixture in which said tungsten disulfide powder has a fineness of 4–25 microns and bears a ratio of one-half ounce powder to four pounds of steel shot; and d. impacting said shot within said mixture upon said bullets by means of said impact device for a period of one to two hours until a plated layer of tungsten disulfide is made to adhere to the outer surface of said bullets.

8. The method of mechanical plating the surface of a bullet with tungsten disulfide by subjecting said bullet to the impact of steel shot in the presence of powdered tungsten disulfide, said impact being produced by rotating said bullet together with said powdered tungsten disulfide and said shot in a tumbler until the desired plated surface is produced.

9. The method of mechanical plating the surface of a bullet with tungsten disulfide by subjecting said bullet to the impact of steel shot in the presence of powdered tungsten disulfide, said impact being produced by vibrating said bullet together with said powdered tungsten disulfide and said shot in a receptacle until the desired plated surface is produced.

10. A method of double plating bullets comprising the steps:

a. placing a selected number of bullets in an impact device containing a receptacle;

b. adding a selected amount of spherical steel shot to said receptacle;

c. mixing said bullets and steel shot with a selected amount of molybdenum disulfide ($MoS_2$) powder within said receptacle forming a mixture;

d. impacting said shot within said mixture upon said bullets by means of said impact device until a plated layer of molybdenum disulfide is made to adhere to the outer surface of said bullets;

e. placing said molybdenum disulfide plated bullets in an impact device containing a receptacle;

f. adding a selected amount of spherical steel shot to said receptacle;

g. mixing said bullets and steel shot with a selected amount of tungsten disulfide ($WS_2$) powder within said receptacle forming a mixture: and h. impacting said shot within said mixture upon said bullets by means of said impact device for a period of one to two hours until a plated layer of tungsten disulfide attains a thickness of approximately 0.00015 inches to 0.00035 inches and is made to adhere to the outer surface of said molybdenum disulfide plated bullets.

11. The method of claim 8 comprising:

a. adding a selected quantity of fibrous material to said previously double plated bullets; and b. polishing said bullets by impacting said fibrous material and said double plated bullets for a selected time.

12. A method of plating tungsten disulfide ($WS_2$) to the outer surface of bullets comprising the steps:

a. placing a selected number of bullets in an impact device having a receptacle;

b. adding a selected amount of spherical steel shot of at least two different sizes to said receptacle;

c. mixing said bullets and steel shot with a selected amount of tungsten disulfide ($WS_2$) powder within said receptacle forming a mixture; and d. impacting said shot within said mixture upon said bullets by means of said impact device for a period of one to two hours until a plated layer of tungsten disulfide attains a thickness of approximately 0.00015 inches to 0.00035 inches and is made to adhere to the outer surface of said molybdenum disulfide plated bullets.

13. The method of claim 12 in which the selected diameter of the larger of said spherical steel shot is generally twice the diameter of the smaller of said spherical steel shot.

14. The method of claim 12 in which the selected diameter of the larger of said spherical steel shot is less than the diameter of said bullets.

15. The method of claim 12 in which said selected amount of spherical steel shot of different sizes is approximately equal by total weight.

16. The method of claim 12 in which said steel shot bears a ratio of four pounds of shot per the equivalent of 100 ,30 caliber bullets.

17. The method of claim 12 in which said tungsten disulfide powder has a fineness of 4–25 microns and bears a ratio of one-half ounce powder to four pounds of steel shot.

18. The method of claim 12 of mechanical plating the surface of a bullet with tungsten disulfide by subjecting said bullet to the impact of said dual sizes of steel shot in the presence of powdered tungsten disulfide, said impact being produced by rotating said bullets together with said powdered tungsten disulfide and said shot in a tumbler until the desired plated surface is produced.

19. The method of claim 12 of mechanical plating the surface of a bullet with tungsten disulfide by subjecting said bullet to the impact of steel shot in the presence of powdered tungsten disulfide, said impact being produced by vibrating said bullet together with said powdered tungsten disulfide and said shot in a receptacle until the desired plated surface is produced.

20. The method of claim 12 comprising:

a. adding fibrous material in said impact device to said previously plated bullets; and b. washing by tumbling or vibrating said previously plated bullets with said fibrous material to clean said tungsten disulfide powder from said plated bullets which has not adhered to the outer surface of said plated bullets.

21. The method of claim 20 wherein:

a. said fibrous material is corn cob grits.

22. A method of double plating bullets comprising the steps:

a. placing a selected number of bullets in an impact device containing a receptacle;

b. adding a selected amount of spherical steel shot of at least two different sizes to said receptacle;

c. mixing said bullets and steel shot with a selected amount of molybdenum disulfide powder within said receptacle forming a mixture; and d. impacting said shot within said mixture upon said bullets by means of said impact device until a plated layer of molybdenum disulfide is made to adhere to the outer surface of said bullets;

e. placing said previously plated bullets in an impact device having a receptacle;

f. adding a selected amount of spherical steel shot of at least two different sizes to said receptacle;

g. mixing said molybdenum disulfide plated bullets and steel shot with a selected amount of tungsten disulfide ($WS_2$) powder within said receptacle forming a mixture; and h. impacting said shot within said mixture upon said previously plated bullets by means of said impact device for a period of one to two hours until a plated layer of tungsten disulfide attains a thickness of approximately 0.00015 inches to 0.00035 inches and is made to adhere to the outer surface of said previously molybdenum disulfide plated bullets.

* * * * *